United States Patent [19]

Reinert et al.

[11] Patent Number: 4,704,133

[45] Date of Patent: Nov. 3, 1987

[54] PROCESS FOR THE PHOTOCHEMICAL STABILIZATION OF SYNTHETIC POLYAMIDE FIBRE MATERIALS WITH WATER-SOLUBLE COPPER COMPLEX DYE

[75] Inventors: Gerhard Reinert, Allschwil; Hans U. Schütz, Basel, both of Switzerland; Gerhard Back, Lörrach, Fed. Rep. of Germany

[73] Assignee: Ciba-Geigy Corporation, Ardsley, N.Y.

[21] Appl. No.: 796,666

[22] Filed: Nov. 12, 1985

[30] Foreign Application Priority Data

Dec. 21, 1984 [CH] Switzerland ..... 6099/84

[51] Int. Cl.[4] ..... D06M 13/50; D06P 1/64; D06P 3/24; C09B 45/08

[52] U.S. Cl. ..... 8/442; 8/587; 8/602; 8/624; 8/676; 8/680; 8/681; 8/685; 8/924

[58] Field of Search ..... 8/442, 602, 587, 685, 8/680, 624

[56] References Cited

U.S. PATENT DOCUMENTS

| | | | |
|---|---|---|---|
| 3,511,827 | 5/1970 | Horning | 8/681 |
| 3,518,245 | 6/1970 | Meininger et al. | 8/681 |
| 3,592,584 | 7/1971 | Link et al. | 8/589 |
| 3,928,328 | 12/1975 | Dhalinal | 556/34 |
| 4,058,515 | 11/1977 | Stingl et al. | 534/842 |
| 4,125,368 | 11/1978 | Stingl et al. | 8/924 |
| 4,383,835 | 5/1983 | Preuss et al. | 8/602 |
| 4,544,372 | 10/1985 | Heise et al. | 8/602 |

FOREIGN PATENT DOCUMENTS 162811 10/1985 European Pat. Off. .

OTHER PUBLICATIONS

Textile Chemists and Colorists 14, 216–221 (1982) "Selecting Dyes for Optimizing Lightfastness of Nylon Automotive Upholstery", by A. Anton.

*Primary Examiner*—A. Lionel Clingman
*Attorney, Agent, or Firm*—Edward McC. Roberts; Meredith C. Findlay

[57] ABSTRACT

A process for the photochemical stabilization of fibre materials made of synthetic polyamides, which comprises treating the fibre material with at least one water-soluble copper complex dye or with a mixture of copper complex compounds containing at least one copper complex dye, or containing at least one copper complex dye in combination with a water-soluble 1:2 cobalt complex dye, 1:2 chromium complex dye, or an azo, anthraquinone, nitroaryl or dioxazine dye.

The fibre materials treated (dyed) by the process of the invention are distinguished by very high tear strength and elongation values after exposure to light or exposure to hot light.

12 Claims, No Drawings

PROCESS FOR THE PHOTOCHEMICAL STABILIZATION OF SYNTHETIC POLYAMIDE FIBRE MATERIALS WITH WATER-SOLUBLE COPPER COMPLEX DYE

The present invention relates to a process for the photochemical stabilisation of synthetic polyamide fibre materials with water-soluble copper complex dyes.

When exposed to light, especially under the simultaneous action of heat, dyed synthetic polyamide fibre material is damaged. Synthetic polyamide fibres are therefore regarded as problem fibres in some fields of application, for example as automobile upholstery materials or sail materials.

An improvement in the photochemical stability of synthetic polyamide fibre materials is sought to meet current requirements.

The use of copper salts, for example copper sulfate, for improving the light-fastness of dyeings on polyamide fibres with metal complex dyes is generally known (reference is made to the article by I. B. Hanes in American Dyestuff Reporter 3 (1980), pages 19 and 20). However, inorganic or even organic copper salts frequently have the disadvantage that their exhaustion onto the polyamide fibres is only inadequate and unlevel and they can therefore often only be used in an after-treatment.

Attempts have therefore been made to use the copper in the form of compounds which have a affinity for the polyamide fibre. Thus, for example, European Pat. No. 0 018 775 recommends the use of copper phosphate, which is said to behave similarly to a disperse dye and accordingly has affinity for nylon fibres. However, such known copper compounds in general have too low a water-solubility, which likewise has an adverse effect on the degree of exhaustion. Moreover, the copper which remains in the dyebath leads to severe pollution of the effluent.

The object of the present invention is therefore to provide a process for the photochemical stabilisation of synthetic polyamide fibre materials, which process does not have the disadvantages described above and meets current requirements.

This object is achieved by using water-soluble copper complex dyes instead of the known copper compounds, which are not very fibre-reactive or have poor water-solubility. These dyes are fibre-reactive and contain water-solubilising groups.

The present invention thus relates to a process for the photochemical stabilisation of fibre materials made of synthetic polyamides, which comprises treating said fibre material with at least one water-soluble copper complex dye or with a mixture of copper complex compounds, at least one component of which is a water-soluble copper complex dye.

The term photochemical stabilisation in the present context relates to lightfastness as well as to the maintainance of the mechanical properties of the non-dyed and dyed polyamide fibres, i.e. photochemical stabilisation against visible and UV light.

Dyed, synthetic polyamide materials of very high photochemical stability are obtained by the process according to the invention.

Preferred embodiments of the process according to the invention comprise using (a) water-soluble copper complex dyes, in particular water-soluble copper complex azo or azomethine dyes, including formazan dyes, (b) mixtures of water-soluble copper complex dyes and, most preferably, (c) mixtures containing at least one water-soluble copper complex dye and at least one copper complex compound which is not a dye. These copper complex compounds are conveniently employed in an amount such that 2 to 1,000 μg of copper, are present per g of polyamide fibre material.

A particularly preferred embodiment of the process of this invention comprises using copper complexes of azo or azomethine dyes of the formula

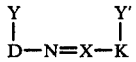

(1)

in which D is a radical of the benzene or naphthalene series, X is a nitrogen atom or the CH group, Y is the HO—, $CH_3O$— or HOOC— group and Y' is the HO— group or an amino group, and in which K, if X is a nitrogen atom, is the radical of a coupling component of the benzene, naphthalene or heterocyclic series or the radical of a ketomethylene compound, or, if X is the CH group, K is the radical of an o-hydroxyaldehyde, which copper complexes contain water-solubilising groups.

In the azo or azomethine dyes of the formula (1), Y or Y' is bonded to D or, respectively, K in the adjacent position to the —N=X— group.

Suitable water-solubilising groups in the copper complex dyes are: sulfone, sulfonamide and N-mono- or N,N-dialkylsulfonamide groups, carboxyl groups, or, in particular, sulfonic acid groups.

Suitable sulfone groups are alkylsulfone groups, in particular $C_{1-4}$alkylsulfone groups.

Suitable N-mono- or N,N-dialkylsulfonamide groups are, in particular, those containing one or two $C_{1-4}$alkyl radicals.

Copper complex dyes containing one or two water-solubilising groups, in particular containing a single water-solubilising group, are used in particular in the process of the invention.

An interesting embodiment of the process of the present invention comprises using a copper complex dye of the formula

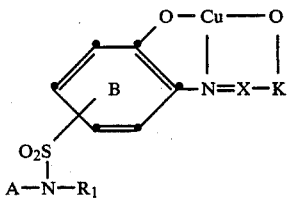

(2)

in which A is a substituted or unsubstituted carboxyphenyl or sulfophenyl radical, $R_1$ is a hydrogen or $C_{1-4}$-alkyl, X is a nitrogen atom or the CH group and K, if X is a nitrogen atom, is the radical of a coupling component of the benzene, naphthalene, pyrazolone, aminopyrazole, acetoacetanilide, 2,4-dioxyquinoline, pyridone or pyridine series, or, if X is the CH group, is the radical of an o-hydroxybenzaldehyde, and the ring B may be further substituted.

Many metallisable azo and azomethine dyes of the formula (1) are described in the literature. The azo dyes of the formula (1) are prepared in a manner which is known per se by diazotising an amine of the formula

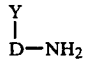

(3)

and coupling the diazonium salt to a coupling component of the formula

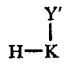

(4)

The diazotisation of the diazo component of the formula (3) is normally carried out by treatment with nitrous acid in aqueous-mineral acid solution at low temperature, and the coupling to the coupling component of the formula (4) is carried out at acid or neutral to alkaline pH values.

Examples of amines of the formula (3) are: 2-amino-1-hydroxybenzene, 2-amino-1-methoxybenzene, anthranilic acid, 4- or 5-sulfonamido-anthranilic acid, 3- or 5-chloroanthranilic acid, 4-chloro- or 4,6-dichloro-2-amino-1-hydroxybenzene, 4- or 5- or 6-nitro-2-amino-1-hydroxybenzene, 4-chloro- or 4-methyl- or 4-acetylamino-6-nitro-2-amino-1-hydroxybenzene, 6-acetylamino- or 6-chloro-4-nitro-2-amino-1-hydroxybenzene, 4-cyano-2-amino-1-hydroxybenzene, 4-methoxy-2-amino-1-hydroxybenzene, 2-amino-1-hydroxybenzene-5-methyl- or -5-benzyl-sulfone, 2-amino-1-hydroxybenzene-4-methyl-, -ethyl-, -chloromethyl- or -butyl-sulfone, 6-chloro-, 5-nitro- or 6-nitro-2-amino-1-hydroxybenzene-4-methylsulfone, 2-amino-1-hydroxybenzene-4- or -5-sulfamide or -sulf-N-methyl- or -sulf-N-β-hydroxyethyl-amide, 2-amino-1-methoxybenzene-4-sulfanilide, 4-methoxy-5-chloro-2-amino-1-hydroxybenzene, 4-methyl-2-amino-1-hydroxybenzene, 4-chloro-5-nitro-2-amino-1-hydroxybenzene, 5-nitro-4-methyl-2-amino-1-hydroxybenzene, 5-nitro-4-methoxy-2-amino-1-hydroxybenzene, 3,4,6-trichloro-2-amino-1-hydroxybenzene, 6-acetylamino-4-chloro-2-amino-1-hydroxybenzene, 4,6-dinitro-2-amino-1-hydroxybenzene, 4-nitro-2-amino-1-hydroxybenzene-5- or 6-sulfonic acid amide, 4- or 5-chloroanisidine, 4- or 5-nitroanisidine, 2-methoxy-5-methylaniline, 2,5-dimethoxyaniline, 2-anisidine-4- or -5-β-hydroxyethylsulfone, 4-methyl-6-sulfo-2-amino-1-hydroxybenzene, 2-amino-4-sulfo-1-hydroxybenzene, 4-chloro-6-sulfo-2-amino-1-hydroxybenzene, 6-chloro-4-sulfo-2-amino-1-hydroxybenzene, 5-nitro-4-sulfo-2-amino-1-hydroxybenzene, 4-nitro-6-sulfo-2-amino-1-hydroxybenzene, 6-nitro-4-sulfo-2-amino-1-hydroxybenzene, 4-acetylamino-2-amino-1-hydroxybenzene, 4-acetylamino-6-sulfo-2-amino-1-hydroxybenzene, 5-acetylamino-2-amino-1-hydroxybenzene, 6-acetylamino-4-sulfo-2-amino-1-hydroxybenzene, 4-chloro-2-amino-1-hydroxybenzene-5-sulfamide, 2-amino-1-hydroxybenzene-4-(N-2'-carboxyphenyl)sulfamide, 1-amino-2-hydroxy-4-sulfonaphthalene, 1-amino-2-hydroxy-4-sulfo-6-nitronaphthalene, 1-amino-2-hydroxy-4-sulfo-6-acetamidonaphthalene, 1-amino-2-hydroxy-4,8-disulfonaphthalene, 1-amino-2-hydroxy-6-sulfonaphthalene, 1-amino-2-hydroxy-7-sulfonaphthalene, 1-amino-2-hydroxy-8-sulfonaphthalene, 2-amino-1-hydroxy-4-sulfonaphthalene and 2-amino-1-hydroxy-6-sulfonaphthalene.

The coupling components of the formula (4) can be derived, for example, from the following groups of coupling components:

Naphthols which couple in the o-position relative to the OH group and are unsubstituted or substituted by chlorine, amino, acylamino, acyl, $C_{1-4}$-alkyl, $C_{1-4}$-alkoxy, sulfonamido, N-mono- or N,N-di-substituted sulfonamido groups or sulfo or sulfone groups.

Naphthylamines which couple in the o-position relative to the amino group and are unsubstituted or substituted by halogen, in particular bromine, $C_{1-4}$-alkyl, $C_{1-4}$-alkoxy, sulfonamido groups, mono- or di-substituted sulfonamido groups or sulfo or sulfone groups.

5-Pyrazolones or 5-aminopyrazoles which have, in the 1-position, a phenyl or naphthyl radical which is unsubstituted or substituted by chlorine, nitro, $C_{1-4}$-alkyl or alkoxy groups, sulfonamido groups, N-alkylated sulfonamido groups, sulfo or sulfone groups or, in particular, amino groups.

2,6-Dihydroxy-3-cyano- or -3-carboxamido-4-alkylpyridines and 6-hydroxy-2-pyridones which are substituted in the 1-position by substituted or unsubstituted $C^{1-4}$-alkyl, for example methyl, isopropyl, β-hydroxyethyl, β-aminoethyl or γ-isopropoxypropyl, or by $—NH_2$ or a substituted amino group, for example dimethylamino or diethylamino, and carry a cyano or carboxamido group in the 3-position and a $C_{1-4}$-alkyl group, in particular methyl, in the 4-position.

Acetoacetic acid anilides and benzoylacetic acid anilides which can be unsubstituted or substituted in the anilide nucleus by $C_{1-4}$-alkyl, alkoxy or alkylsulfonyl groups, $C_{1-4}$-hydroxyalkyl, alkoxyalkyl or cyanoalkysulfonyl groups, sulfonamido groups, N-alkylated sulfonamido groups, sulfo, acetylamino or halogen.

Phenols which are substituted by low molecular acylamino groups and/or by alkyl groups containing 1 to 5 carbon atoms, and which couple in the o-position.

Examples of such coupling components are: 2-naphthol, 1-naphthol, 1-hydroxynaphthalene-4- or -5-sulfonic acid, 1,3- or 1,5-dihydroxynaphthalene, 1-hydroxy-7-aminonaphthalene-3-sulfonic acid, 2-naphthol-6-sulfonamide, 1-hydroxy-7-N-methyl- or N-acetyl-aminonaphthalene-3-sulfonic acid, 2-naphthol-6-β-hydroxyethylsulfone, 1-hydroxy-6-amino- or 6-N-methyl- or -6-N-acetyl-aminonaphthalene-3-sulfonic acid, 1-hydroxy-7-aminonaphthalene-3,6-disulfonic acid, 1-hydroxy-6-aminonaphthalene-3,5-disulfonic acid, 1-acetylamino-7-naphthol, 1-hydroxy-6-N-(4'-aminophenyl)-aminonaphthalene-3-sulfonic acid, 1-hydroxy-5-aminonaphthalene-3-sulfonic acid, 1-propionylamino-7-naphthol, 2-hydroxy-6-aminonaphthalene-4-sulfonic acid, 1-carbomethoxyamino-7-naphthol, 1-hydroxy-8-aminonaphthalene-5-sulfonic acid, 1-carboethoxyamino-7-naphthol, 1-hydroxy-8-aminonaphthalene-5,7-disulfonic acid, 1-carbopropoxy-amino-7-naphthol, 1-hydroxy-8-aminonaphthalene-3-sulfonic acid, 1-dimethylaminosulfonyl-amino-7-naphthol, 6-acetylamino-2-naphthol, 1-hydroxy-8-amino-naphthalene-3,5- or -3,6-disulfonic acid, 4-acetylamino-2-naphthol, 2-hydroxy-5-aminonaphthalene-4,7-disulfonic acid, 4-methoxy-1-naphthol, 4-acetylamino-1-naphthol, 1-naphthol-3-, 4- or 5-sulfonamide, 2-naphthol-3-, -4-, -5-, -6-, -7- or -8-sulfonamide, 5,8-dichloro-1-naphthol, 5-chloro-1-naphthol, 2-naphthylamine, 2-naphthylamine-1-sulfonic acid, 2-aminonaphthalene-5-, -6- or -7-sulfonamide, 2-aminonaphthalene-6-sulfonic acid N-methyl-, -ethyl-, -isopropyl-, -β-oxyethyl- or -γ-methoxypropyl-amide, 2-aminonaphthalene-6-sulfanilide, 2-aminonaphthalene- 6-sulfonic acid N-methylanilide, 1-aminonaphthalene-3-, -4- or -5-sulfonamide, 1-aminonaphthalene-5-methyl- or -ethylsulfone, 5,8-dichloro-1-aminonaphthalene, 2-phenylaminonaphthalene, 2-N-methylaminonaphthalene, 2-N-ethylaminonaphthalene, 2-phenylaminonaphthalene-5-, -6- or -7-sulfonamide, 2-(3'-chlorophenylamino)-naphthalene-5-, -6- or -7-sulfonamide, 6-methyl-2-aminonaphthalene, 6-bromo-2-amino-naphthalene, 6-methoxy-2-aminonaphthalene, 1,3-dimethylpyrazolone, 3-methyl-5-pyrazolone, 1-phenyl-3-methyl-5-pyrazolone, 1-phenyl-3-carboxamido-5-pyrazolone, 1-(2'-, 3'- or 4'-methylphenyl)-3-methyl-5-pyrazolone, 1-[3'- or 4'-(-hydroxyethylsulfonyl)-phenyl]-3-methyl-5-pyrazolone, 1-(2'-methoxyphenyl)-3-methyl-5-pyrazolone, 1-(2'-, 3'- or 4'-chlorophenyl)-3-methyl-5-pyrazolone, 1-(2'-, 3'- or 4'-nitrophenyl)-3-methyl-5-pyrazolone, 1-(2',5'- or 3',4'-dichlorophenyl)-3-methyl-5-pyrazolone, 1-(2'-, 3'- or 4'-sulfamoylphenyl)-3-methyl-5-pyrazolone, 1-(2'-, 3'- or 4'-methylsulfonylphenyl)-3-methyl-5-pyrazolone, 2,6-dihydroxy-3-cyano-4-methylpyridine, 1-methyl-3-cyano-4-ethyl-6-hydroxypyrid-2-one, 1-amino-3-cyano-4-methyl-6-hydroxypyrid-2-one, 1-phenyl-3-carboxamido-4-methyl-6-hydroxypyrid-2-one, acetoacetanilide, acetoacet-o-, -m- or -p-sulfoanilide, acetoacet-4-(-hydroxyethylsulfonyl)-anilide, acetoacet-o-anisidide, acetoacetnaphthylamide, acetoacet-o-toluidide, acetoacet-o-chloroanilide, acetoacet-m- or -p-chloroanilide, acetoacetanilide-3- or -4-sulfonamide, acetoacet-3- or -4-aminoanilide, acetoacet-m-xylidide, benzoylacetic acid anilide, 4-methylphenol, 3-dialkylaminophenol, in particular 3-dimethylamino- and 3-diethylamino-phenol, 4-t-butylphenol, 4-t-amylphenol, 2- or 3-acetylamino-4-methylphenol, 2-methoxycarbonylamino-4-methylphenol, 2-ethoxycarbonylamino-4-methylphenol, 3,4-dimethylphenol and 2,4-dimethylphenol, 1-(4'-aminophenyl)-3-methyl-5-pyrazolone, 1-(2'-, 3'- or 4'-sulfophenyl)-3-methyl-5-pyrazolone, 1-(2'-chloro-4'- or 5'-sulfophenyl)-3-methyl-5-pyrazolone, 1-(2'-methyl-6'-chlorophenyl)-3-methyl-5-pyrazolone, 1-(2'-methyl-4'-sulfophenyl)-3-methyl-5-pyrazolone, 1-(2'-, 3'- or 4'-chloro- or methyl- or sulfophenyl)-3-carboxy-5-pyrazolone, 1-[5'-sulfonaphth-2'-yl]-3-methyl-5-pyrazolone, 1-[4''-amino-2',2''-disulfo-4'-stilbene]-3-methyl-5-pyrazolone, 1-ethyl-3-cyano-4-methyl-6-hydroxypyrid-2-one, 1-ethyl-3-sulfomethyl-4-methyl-6-hydroxy-pyrid-2-one, 2,6-dihydroxy-3-cyano-4-sulfomethylpyridine and 2,4,6-trihydroxypyrimidine, 2,3-dihydroxypyridine, 5-bromo- (or chloro)-2,3-dihydroxypyridine, 2-amino-3-hydroxypyridine, 5-bromo-2-amino-hydroxpyridine, 5-ethylmercapto-2,3-dihydroxypyridine, 5-phenylsulfonyl-2,3-dihydroxypyridine, 2,3-dihydroxypyridine-5-sulfonic acid and 3-amino-3-hydroxypyridine-5-sulfonic acid.

To prepare the azomethine dyes of the formula (1), the abovementioned aromatic amines of the formula (3) are subjected to a condensation reaction with o-hydroxybenzaldehydes or o-hydroxynaphthaldehydes in known manner.

Examples of suitable aldehydes are: 2-hydroxybenzaldehyde, 3- or 5-methyl-2-hydroxybenzaldehyde, 3,5- or 3,6-dimethyl-2-hydroxybenzaldehyde, 5-butyl-2-hydroxybenzaldehyde, 5-chloro- or -bromo-2-hydroxybenzaldehyde, 3- or 4-chloro-2-hydroxybenzaldehyde, 3,5-dichloro-2-hydroxybenzaldehyde, 3-chloro-5-methyl-2-hydroxybenzaldehyde, 3-methyl-5-chloro-2-hydroxybenzaldehyde, 3- or 4- or 5-nitro-2-hydroxybenzaldehyde, 3,5-dinitro- or 4-chloro-5-nitro-2-hydroxybenzaldehyde, 4-methoxy-2-hydroxybenzaldehyde, 1-hydroxy-2-naphthaldehyde and its derivative chlorinated in the 4-position and 2-hydroxy-1-naphthaldehyde.

One process variant for the preparation of the copper complex of an azomethine dye of the formula (1) comprises also preparing the copper complex with a mixture of the amine of the formula (3) and an o-hydroxyaldehyde instead of with the azomethine of the formula (1).

The metal complexes are prepared by methods which are known per se in an aqueous or organic medium. Copper salts, for example copper sulfate and copper nitrate, are used as copper donors. The freshly precipitated hydroxides can also be used. The reaction is carried out in a weakly acid to alkaline range. The reaction is carried out, for example, with copper sulfate in aqueous medium, in the presence of sodium acetate or ammonia, or with copper nitrate, in the presence of sodium carbonate, in an organic medium such as methylcellosolve.

The reaction is generally carried out with heating, for example to a temperature somewhat below the boiling point of the solvent employed.

Another embodiment of the process according to the invention comprises using a mixture containing at least one water-soluble copper complex dye and a fibre-reactive, water-soluble copper complex of an organic compound which is not a dye, i.e., which does not contain chromophoric groups.

Copper complex dyes in the above mixture are the copper complex dyes mentioned above.

Non-chromophoric components are preferably sulfo group containing copper complexes of bisazomethines, acylhydrazone, semicarbazones and thiosemicarbazones of aromatic aldehydes or ketones. Such compounds are readily water-soluble and also have an excellent affinity for polyamide fibre. Such complexes are therefore already effective in small amounts. It has also been found that not only do they increase the lightfastness of the dyed polyamide material, but they also quite generally protect the polyamide fibres from photochemical degradation and thus substantially maintain the mechanical properties of the fibres, such as tear strength and resilience.

Bisazomethines of aromatic aldehydes and ketones will be understood in this context as meaning Schiff's bases of aliphatic, cycloaliphatic or aromatic diamines, which aldehydes and ketones carry an OH group in the o-position relative to the formyl or acyl radical. Bonding with the metal atom is effected via these two OH groups and the two nitrogen atoms in the bisazomethine part. These are accordingly tetradentate ligands. The ligands contain one or more sulfo groups, which are present in the aldehyde or ketone moiety and/or in the bisazomethine bridge.

Preferred embodiments of the processes of the invention comprise using a mixture containing a copper complex dye and a non-chromophoric copper complex (a) of the formula

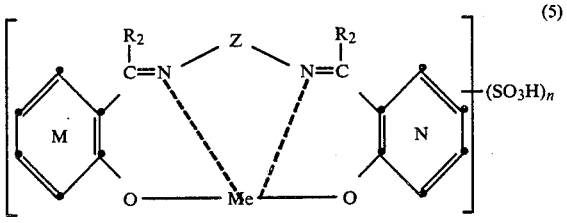

(5)

in which Me is copper, $R_2$ is hydrogen or a substituted or unsubstituted alkyl or aryl radical, Z is a substituted or unsubstituted alkylene, cycloalkylene or arylene radical and n is 1, 2 or 3; or (b) of the formula

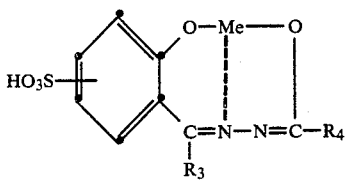

(6)

in which Me is copper, and $R_3$ and $R_4$, each independently of the other, have the same meaning as $R_2$; or (c) of the formula

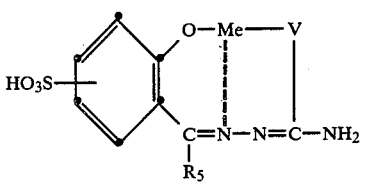

(7)

in which Me is copper, $R_5$ is hydrogen or a substituted or unsubstituted alkyl or aryl radical and V is an oxygen or sulfur atom.

A substituted or unsubstituted alkyl radical $R_2$, $R_3$ or $R_5$ is preferably a $C_1$–$C_8$alkyl radical, in particular a $C_1$–$C_4$alkyl radical which may be branched or non-branched and unsubstituted or substituted by halogen such as fluorine, chlorine or bromine, $C_1$–Calkoxy such as methoxy or ethoxy, by a phenyl or carboxyl radical, by $C_1$–$C_4$alkylcarbonyl, for example the acetyl radical, or by hydroxyl or a mono- or dialkylated amino group. The cyclohexyl radical is also possible and can likewise be substituted, for example by $C_1$–$C_4$alkyl or $C_1$–$C_4$alkoxy.

An unsubstituted or substituted aryl radical $R_2$, $R_3$ or $R_5$ is, in particular, a phenyl or naphthyl radical which can be substituted by $C_1$–$C_4$alkyl, such as methyl, ethyl, propyl, isopropyl, butyl, isobutyl, sec-butyl or tert-butyl, $C_1$–$C_4$alkoxy such as methoxy, ethoxy, propoxy, isopropoxy, butoxy, isobutoxy, sec-butoxy and tert-butoxy, halogen such as fluorine, chlorine or bromine, $C_2$–$C_5$alkanoylamino such as acetylamino, propionylamino or butyrylamino; or by nitro, cyano, sulfo or a mono- or dialkylated amino group.

An alkylene radical Z is, in particular, a $C_2$–$C_4$-alkylene radical, in particular a —$CH_2$—$CH_2$— bridge. It may also be, however, a $C_2$–$C_8$alkylene chain which is interrupted by oxygen or, in particular, by nitrogen, and especially the —$(CH_2)_3$—NH—$(CH_2)_3$— bridge.

A cycloalkylene radical Z is preferably cyclohexylene and may contaain one or two methyl groups.

An arylene radical Z is, in particular, a phenylene radical, especially an o-phenylene radical. This can likewise be substituted by $C_1$–$C_4$alkyl or $C_1$–$C_4$alkoxy.

Substituents of the benzene rings M and N are: $C_1$–$C_4$alkyl, $C_1$–$C_4$alkoxy, halogen such as fluorine, chlorine or bromine, and also the cyano or nitro group.

The sulfo groups present in the benzene rings M and/or in the bridge member Z, if it is an arylene radical, are preferably in the form of the alkali metal salt, most preferably the sodium salt, or also as the amine salt.

The copper complexes of the formula (5), in which $R_2$ is hydrogen, Z is the ethylene or cyclohexylene bridge and n is 2, with the two sulfo groups being present in the benzene rings M and N, are particularly used in the present process, and, of these, especially the complexes in which the sulfo groups are in each case located in the p-position relative to the oxygen. Z is most preferably —$CH_2$—$CH_2$—.

An alkyl radical $R_4$ may be branched or straight-chain and has a chain length of preferably 1 to 8, in particular 1 to 4, carbon atoms. Substituents are halogen such as fluorine, chlorine or bromine, $C_1$–$C_4$alkoxy such as methoxy or ethoxy, and also phenyl or carboxyl, $C_1$–$C_4$alkylcarbonyl, for example acetyl, or hydroxyl or mono- or dialkylamino.

An unsubstituted or substituted aryl radical $R_4$ is, in particular, a phenyl or naphthyl radical which can be substituted by $C_1$–$C_4$alkyl such as methyl, ethyl, propyl, isopropyl, butyl, isobutyl, sec-butyl or tert-butyl, $C_{1-4}$-alkoxy such as methoxy, ethoxy, propoxy, isopropoxy, butoxy, isobutoxy, sec-butoxy or tert-butoxy, halogen such as fluorine, chlorine or bromine, $C_{2-5}$alkanoylamino such as acetylamino, propionylamino or butyrylamino; or by nitro, cyano, sulfo or a mono- or dialkylated amino group.

The complexes of the formula (6) are also preferably used in the neutral form, i.e. as the alkali metal salt, in particular the sodium salt, or as the amine salt.

It is preferred to use those complexes of the formula (6), in which $R_3$ is hydrogen and $R_4$ is hydrogen, methyl or, in particular, the phenyl radical, and especially the complexes in which the sulfo group is again in the p-position relative to the oxygen.

In addition to the copper complexes of the formulae (6) and (7), the ligands of which are derived from sulfosalicylaldehyde or the corresponding phenyl ketones, it is also possible to use for example those in which, instead of mononuclear, polynuclear aromatic aldehydes and ketones, for example 2-hydroxy-1-naphthaldehydesulfonic acid, have been used for building up the ligand. In addition, it is pointed out that the fourth co-ordination site of the metal atom in the complexes of the formulae (6) and (7) is occupied by water as a neutral ligand.

The copper complexes of the formulae (5) and (6) are most preferably used in the present process for photochemical stabilisation.

In the process of this invention, the ratio of copper complex dye: fibre-reactive, water-soluble copper complex of an organic compound, which is itself not a dye, is preferably 99:1 to 10:90.

The mixture ratio depends on the number of copper complex dyes used and the desired depth of shade of the dyeings.

The copper complexes of the indicated formulae (5), (6) and (7) and alkali metal salts thereof, such as potassium and lithium salts, and especially sodium salts thereof, are obtained by known methods.

The metal complexes of the formula (5) are accessible, for example, by two different routes. Thus, on the one hand, the aldehyde or the ketone can first be metallised and the product then reacted with the corresponding diamine to give the final complex of the formula (5). However, it is also possible first to synthesise the ligand from the aldehyde or ketone and diamine and then to carry out the metallisation.

The acyl hydrazones, the ligands of the complexes (6), are obtained, for example, by reaction of the aldehyde or ketone with the corresponding monoacylhydrazine and subsequent metallisation. The complexes of the formula (7) can be prepared completely analogously. At least one of the starting materials for the preparation of the compounds of the formula (5), (6) and (7) must contain a sulfonic acid group.

It is preferred to use the copper complexes of the formulae (5) to (7), most preferably the copper complexes of the formulae (5) and (6).

Complexes which are especially preferred within the group of metal complexes with a bisazomethine ligand are the copper complexes of the formulae (8)

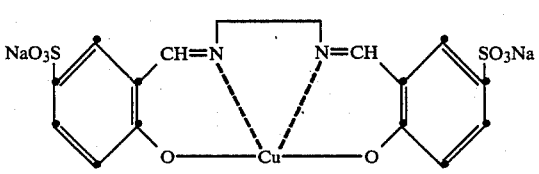

(9)

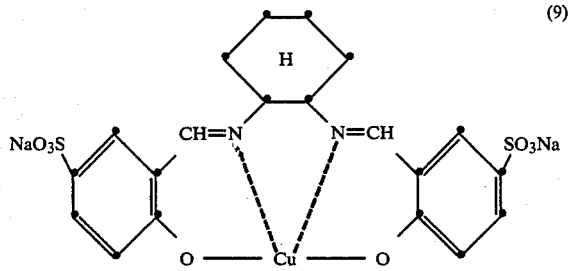

and those especially preferred within the group of metal complexes with acylhydrazone ligands are the copper complexes of the formulae (10)

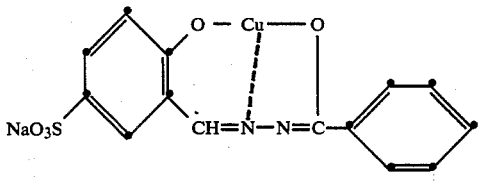

(11)

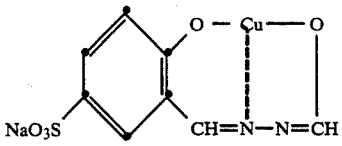

-continued (12)

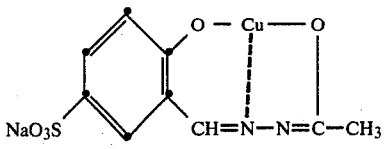

The fourth coordination site of the copper in the complexes of the formulae (10), (11) and (12) is occupied by water, without this being expressly indicated in the structural formulae.

Another preferred embodiment of the process according to the invention comprises using at least one copper complex dye together with acid dyes, in particular in the same dyebath.

Examples of suitable acid dyes are metal-free mono- or polyazo dyes, 1:2 chromium or 1:2 cobalt complex azo dyes, anthraquinone, dioxazine, phthalocyanine, nitroaryl or stilbene dyes, each of which contains at least one acid group for example a carboxyl group or, in particular a sulfonic acid group.

An interesting embodiment of the process of the invention comprises using, for trichromatic dyeing, a mixture of at least one red dye, at least one yellow or orange dye and at least one blue dye, said mixture containing at least one copper complex dye.

The polyamide fibre material used in the process of the present invention is polyamide fibre material made of synthetic polyamides, for example polyamide 6, polyamide 66 or polyamide 12.

In principle, the polyamide fibre material may be in the most diverse processing forms, for example fibres, yarn, woven fabric or knitted fabric, in particular as textile fibre material.

The dyes containing sulfo groups used in the process of the present invention are either in the form of their free sulfonic acid or, preferably, salts thereof.

Examples of salts are the alkali metal, alkaline earth metal or ammonium salts or the salts of an organic amine. Examples are the sodium, lithium, potassium or ammonium salts or the triethanolamine salt.

The dyes used in the process of this invention as a rule contain other additives, for example sodium chloride or dextrin.

The process of this invention for dyeing synthetic polyamide fibre materials is susceptible of application to the customary dyeing methods.

In addition to containing water and the dyes, the dye liquors can contain other auxiliaries, for example wetting agents, antifoams, levelling agents, salts, acids or buffers.

Synthetic polyamide fibre materials are photochemically stabilised, i.e. protected from exposure to light, in particular exposure to hot light, with visible and UV light, by the process of this invention.

An advantage of the process of the invention which merits particular mention is that, in comparison with the prior art processes for the photochemical stabilisation of synthetic polyamide fibre materials, no pretreatment or aftertreatment of the fibre material is necessary.

The mixtures of copper complex dyes with non-chromophoric copper complex compounds employed in the process of this invention have the advantage that, irrespective of the desired depth of shade of the dyeings obtained with the copper complex dyes, a constant copper content of the fibres can be established, i.e. the protective effect is not subject to any variations caused by shade.

The photochemical stabilisation of the fibre material is tested, for example, in a fadeometer at a "black panel temperature" of 83° C. [exposure to hot light] or by exposure to light in a Xenotest apparatus in accordance with SN (Swiss Standard) ISO 105 B 02 (=Xenon) and subsequent testing of the tear strength and extension of the material in accordance with SNV standards 97461 and 198.461.

In the following Examples, parts are by weight. The relationship of parts by weight to parts by volume is the same as that of the gram to the cubic centimeter. The tear strength and elongation values of untreated and non-exposed polyamide fibre material are taken as 100%.

EXAMPLE 1

Seven strands of yarn of polyamide 66, weighing 10 g each, are treated in a dyeing apparatus (for example a dyeing apparatus with open treatment baths) with liquors (liquor ratio of 1:20) which generally contain 2% of ammonium sulfate (pH 6.5) and the following dyes:

treatment bath 1: no dye added, with exposure to light and with treatment;

treatment bath 2: 0.025% of the yellow dye of the formula (100)

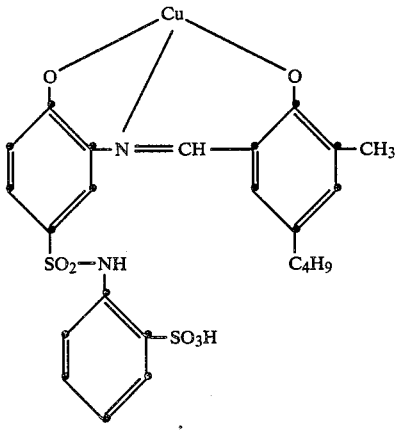

treatment bath 3: 0.5% of the dye of the formula (100);

treatment bath 4: 0.025% of the red dye of the formula (101)

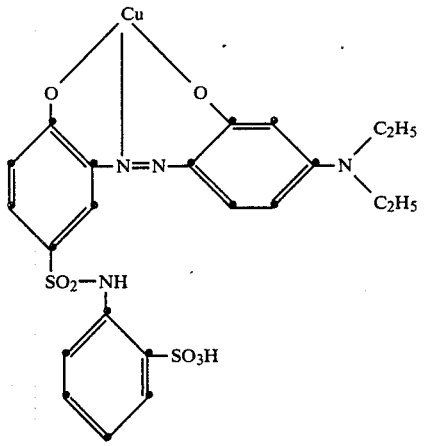

treatment bath 5: 0.5% of the dye of the formula (101);

treatment bath 6: 0.025% of the blue dye of the formula (102)

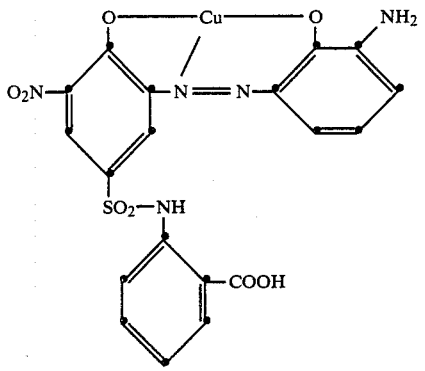

treatment bath 7: 0.5% of the dye of the formula (102).

The yarn is first treated at 50° for 5 minutes in the prepared liquors and the baths are then heated at a rate of 2°/minute to 95° C. For exhaustion of the dyebaths, 2% of acetic acid (80%) are added after 15 minutes at 95° C., treatment is continued for a further 30 minutes and the bath is then cooled to 70°. The treated yarn is rinsed warm and cold, centrifuged and dried at 80° in a drying cabinet.

One portion of the yarn from the individual treatments is wound onto a card and exposed to light in a Fade-Ometer (manufacturer: Atlas Electric Devices Co., Chicago) for 250 hours at a "black panel temperature" of 83°.

Another portion of the yarn from the individual treatments is wound onto card and exposed to light in a Xenotest apparatus (manufactuer: Quarzlampengesellschaft, Hanau) for 1,000 hours [SN (Swiss Standard)—ISO 105 B02].

The yarn from both exposure tests is then tested for its tear strength and elongation values in accordance with SNV (Swiss Standard Association) Standard 97 461. The following results are obtained, the tear strength and elongation values of non-exposed and untreated polyamide 66 fibre material being taken as 100%.

TABLE 1

| Treatment bath | Tear strength | | Elongation | |
|---|---|---|---|---|
| | Fade-Ometer | Xenon | Fade-Ometer | Xenon |
| no treatment no exposure to light | 100% | 100% | 100% | 100% |
| 1 | 14.5% | 58% | 25.7% | 123.3% |
| 2 | 36.7% | 83.9% | 59.9% | 113.8% |
| 3 | 94.4% | 103% | 113.4% | 138.2% |
| 4 | 39.2% | 87.6% | 62.9% | 114.7% |
| 5 | 93.2% | 102.1% | 112.5% | 130.2% |
| 6 | 43.8% | 86.6% | 68.5% | 113.9% |
| 7 | 65.8% | 91.3% | 90.1% | 116% |

It is evident from the table that good to outstanding protection from photochemical degratation is conferred on the dyed polyamide fibre material by the presence of the dyes in treatment baths (2) to (7). The protection already takes effect at a minimal copper content of the fibres [treatment baths (2), (4) and (6)].

EXAMPLE 2

4 strands of yarn of polyamide 66 fibre material with the following dye combinations are dyed in accordance with Example 1:

treatment bath 1: no addition of dye, with exposure to light and with treatment;

treatment bath 2:

0.07% of the dye of the formula (100), 0.012% of the dye of the formula (101) and 0.015% of the dye of the formula (102);

treatment bath 3:

0.055% of the dye of the formula (100), 0.036% of the dye of the formula

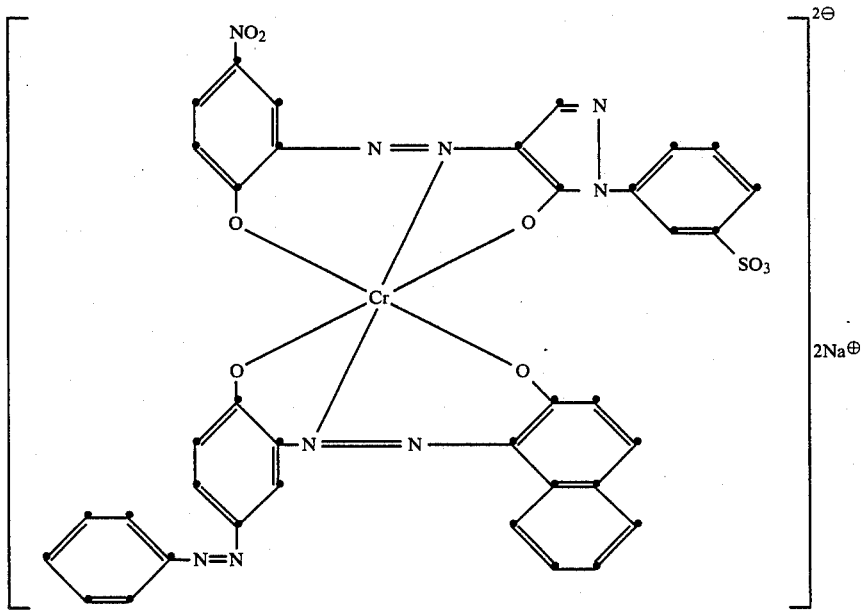

(103)

and 0.003% of the dye of the formula

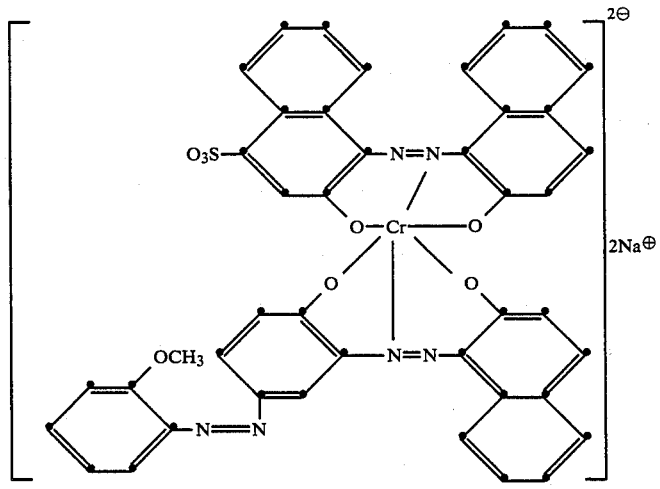

(104)

treatment bath 4:

0.04% of the 1:2 cobalt complex of the dye of the formula

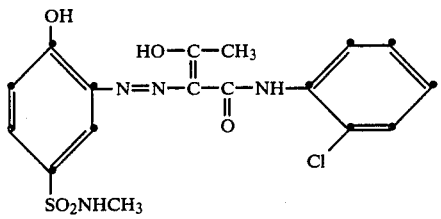

(105)

0.025% of the dye of the formula (103) and (0.003% of the dye of the formula (104).

The dye combinations give a beige dyeing of the same shade in all 3 cases.

Dyeing and testing of the dyed yarn are carried out as described in Example 1, but the yarn was exposed to light in the Fade-Ometer for only 200 hours at the black panel temperature of 83° C.

The following results are obtained:

TABLE 2

| Treatment bath | Tear strength | Elongation |
|---|---|---|
| without treatment without exposure to light | 100% | 100% |
| 1 | 46.8% | 83.9% |
| 2 | 81.0% | 103.2% |
| 3 | 81.6% | 113.0% |
| 4 | 46.2% | 82.6% |

It is evident from the table that treatment bath (4) with the dye combination of the dyes of the formulae (103), (104) and (105) affords virtually no protective effect on the fabric; but as soon as one or more Cu complex dyes are on the fibre [treatment baths (2) and (3)], a very good fibre protection results.

EXAMPLE 3

As described in Example 1, 4 strands of yarn of polyamide 66 fibre material, weighing 10 g each, are dyed and finished. The same olive shade is obtained with the 3 different dye combinations of the various metal complex dyes. Treatment bath 1: no addition of dye, with exposure to light and with treatment;

treatment bath 2:

0.105% of the dye of the formula (100), 0.02% of the dye of the formula (101) and 0.065% of the dye of the formula (102);

treatment bath 3:

0.055% of the dye of the formula (100), 0.008% of the dye of the formula (101), 0.08% of the 1:2 cobalt complex of the dyes of the formulae

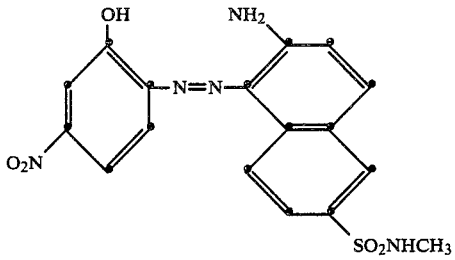

(106)

-continued

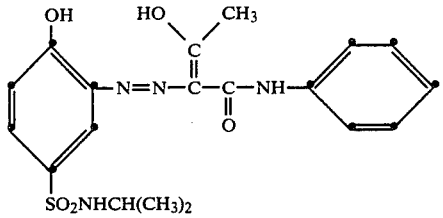

and 0.035% of the 1:2 cobalt complex of the dye of the formula (105);

treatment bath 4:

0.05% of the 1:2 cobalt complex of the dye of the formula

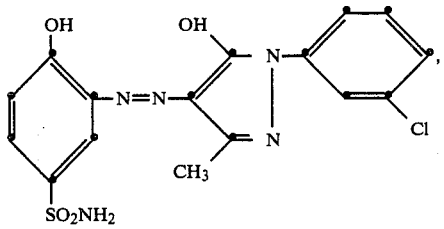

(107)

0.085% of the 1:2 cobalt complex of the dyes of the formulae (106) and 0.035% of the dye of the formula (104).

As described in Example 1, the 4 dyed polyamide yarns are exposed to hot light for 200 hours and then tested for tear strength and elongation. The results are reported in the following table.

TABLE 3

| Treatment bath | Tear strength | Elongation |
|---|---|---|
| without treatment without exposure to light | 100% | 100% |
| 1 | 46.8% | 83.9% |
| 2 | 85.5% | 107.1% |
| 3 | 85.8% | 110.8% |
| 4 | 66.0% | 91.2% |

The comparison clearly shows that the presence of copper complex dyes in the polyamide fibre material results in better fibre stabilisation [treatment baths (2) and (3)], than with the cobalt complex dyes [treatment bath (4)].

EXAMPLE 4

As described in Example 1, dyeing is carried out with six combinations of two of the three dyes described therein.

| Dye of the formula | Treatment bath 1 | 2 | 3 | 4 | 5 | 6 | 7 |
|---|---|---|---|---|---|---|---|
| (100) | — | 0.1% | 0.5% | — | — | 0.1% | 0.3% |
| (101) | — | — | — | 0.1% | 0.3% | 0.1% | 0.3% |
| (102) | — | 0.02% | 0.1% | 0.1% | 0.3% | — | — |

The dyed polyamide yarn is exposed to hot light for 200 hours (see Example 1) and then tested for tear strength and elongation according to SNV 97,461. The values are based on untreated, non-exposed polyamide fibre material (=100%). The following results are obtained with the exposed yarn.

| Treatment/Dyeing | Tear strength | Elongation |
|---|---|---|
| Treatment 1 | 46.8% | 83.9% |
| Treatment 2 (green) | 88.5% | 113.3% |
| Treatment 3 (green) | 95.1% | 125.5% |
| Treatment 4 (violet) | 77.5% | 101.2% |
| Treatment 5 (violet) | 79.3% | 106.1% |
| Treatment 6 (orange) | 90.0% | 118.3% |
| Treatment 7 (orange) | 91.6% | 123.1% |

EXAMPLE 5

The experiments described in Example 1, which result in light yellow, red and blue dyeings (treatment baths 2, 4 and 6), and the blank treatment (treatment bath 1) are repeated with the addition of 0.075% (based on the weight of the goods) of the compound of the formula

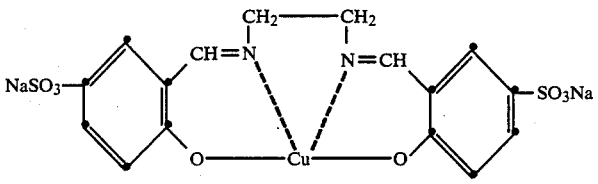

and the yarn is then subjected to the exposure to hot light test in the Fade-Ometer and the exposure to light test in Xenotest apparatus as described in Example 1. The dyeings obtained with the addition of the compound of the formula (108) are designated in the following table as treatment bath 1A, 2A, 4A and 6A and are compared with the results of Example 1.

Testing of the exposed dyeings and blank treatments for tear strength and extension gives the results shown in the following table:

TABLE 4

| Treatment bath | Tear strength | | Elongation | |
|---|---|---|---|---|
| | Fade-Ometer | Xenon | Fade-Ometer | Xenon |
| no treatment no exposure to light | 100% | 100% | 100% | 100% |
| 1 | 14.5% | 58% | 25.7% | 89.8% |
| 1A | 69.3% | 95.4% | 92.2% | 123.3% |
| 2 | 36.7% | 83.9% | 59.9% | 113.8% |
| 2A | 75.9% | 100% | 100.9% | 130.7% |
| 4 | 39.2% | 87.6% | 62.9% | 114.7% |
| 4A | 77.3% | 101.8% | 98.8% | 126.0% |
| 6 | 43.8% | 86.6% | 68.5% | 113.9% |
| 6A | 83.8% | 99.3% | 105.2% | 123.7% |

Table 4 clearly shows that the photochemical stability of light dyeings with copper complex dyes on synthetic polyamide materials [treatment baths (2), (4) and (6)] can be improved still further by adding colourless fibre-reactive copper complex compounds [treatment baths (2A), (4A) and (6A)].

The dyeing procedures described in Example 5 are repeated using 0.075% (based on the weight of the goods) of the compound of the formula

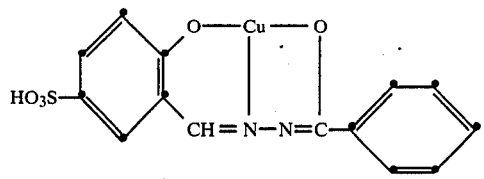

(109)

or 0.075% of the compound of the formula

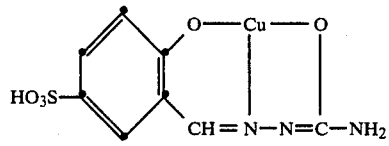

(110)

instead of the copper complex of the formula (108) and (108)

subsequently subjecting the dyed fabric to the hot light exposure test in the Fade-Ometer and to exposure in the xenotest apparatus as described in Example 5. An appreciable additional improvement in the photochemical stability of the dyeings is obtained.

EXAMPLE 6

Dyeings are produced on nylon filament yarn with 0.05% of the dye of the formula (100) as described in Example 1, except that dyeing is carried out at 95° C. using 0.05% of each of the copper complex compounds of the formulae (108), (109) and (110) and with the addition of 2% of 80% acetic acid.

The material is exposed in accordance with DIN 75202 (Fakra) and Xenon (SN-ISO 105B02) and tested for its tear strength and elongation properties. The following results are obtained (the tear strength and elongation values of unexposed and untreated polyamide fabric=100%).

TABLE 5

| Copper comples | Tear strength | | Elongation | |
|---|---|---|---|---|
| | Fakra | Xenon | Fakra | Xenon |
| none | 14.3% | 41.2% | 21.0% | 72.6% |
| (100) alone | 30.2% | 91.3% | 52.4% | 111.2% |
| (100) + (108) | 72.2% | 101.2% | 90.5% | 120.6% |
| (100) + (109) | 77.3% | 101.1% | 92.2% | 127.7% |
| (100) + (110) | 61.6% | 98.7% | 82.6% | 118.7% |

EXAMPLE 7

10 g of nylon filament yarn (glossy) are dyed in a laboratory dyeing apparatus with open dyebaths, at a liquor ratio of 1:30, in liquors which contain 2% (based on the weight of the goods) of ammonium sulfate and 0.1% of the dyes of the formulae (111) to (118) indicated below. The yarn is put into the dyebath at 40° C., treated for 5 minutes and the temperature is raised to 95° C. Dyeing is carried out for 45 minutes at this temperature. The dyebath is then cooled to about 60° C. and the dyeings are rinsed with cold water and dried at 105° C. in a drying cabinet.

The yarn is then wound on cardboard and exposed in a Fade-Ometer at a temperature of 83° C. The unexposed and exposed yarn is finally tested for its tear strength and elongation in accordance with SN 97.461.

As the comparison with the blank dyeing (yarn not treated with dye) or with a conventional dyeing obtained with the dyes of the formulae (104) (106) and (107) shows, an appreciable improvement in the photochemical stability of the fabric is obtained with all copper complex dyes.

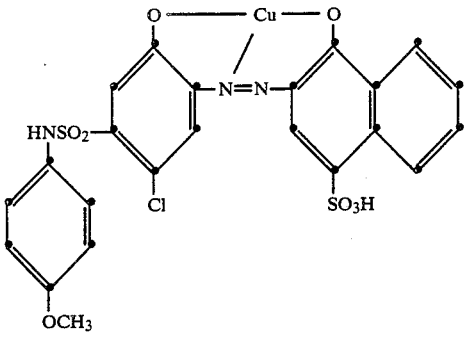

(111)

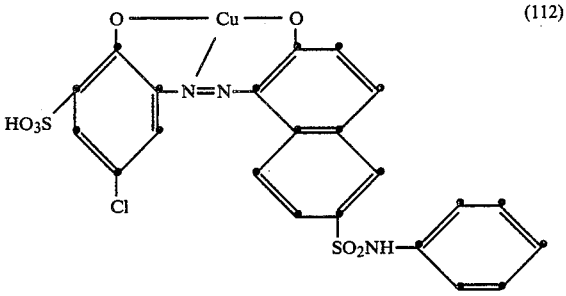

(112)

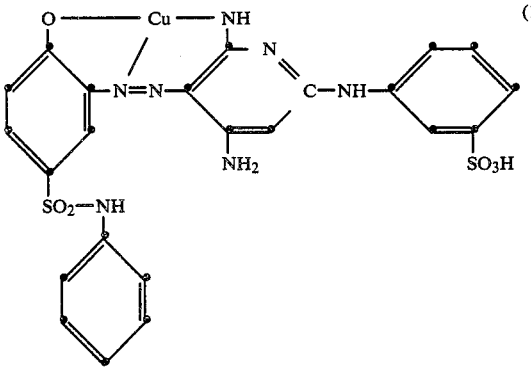

(113)

-continued

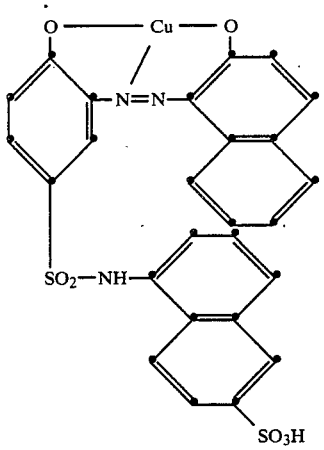

(114)

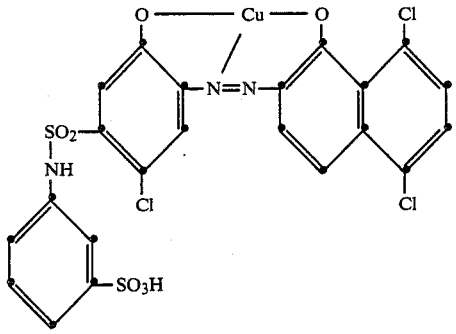

(115)

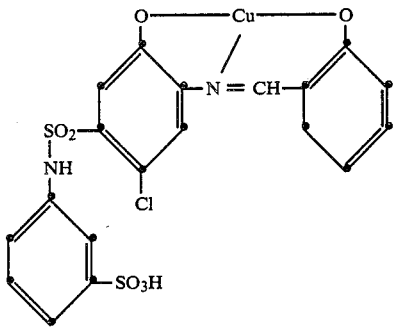

(116)

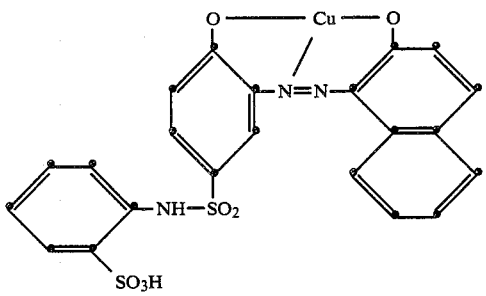

(117)

-continued (118)

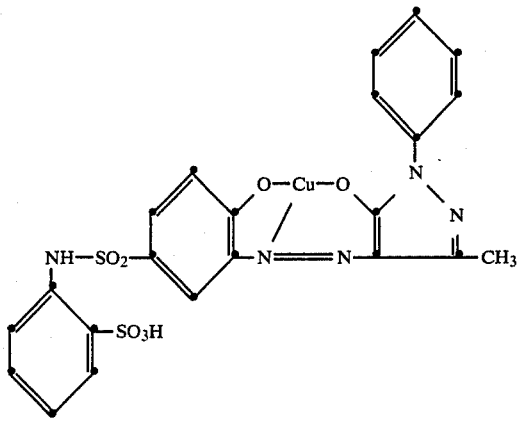

TABLE 6

| Dye | Tear strength unexposed | Tear strength exposed | Elongation unexposed | Elongation exposed |
|---|---|---|---|---|
| (111) | 93.8% | 83.6% | 115.6% | 96.4% |
| (112) | 93.2% | 87.9% | 119.4% | 106.3% |
| (113) | 93.6% | 84.3% | 114.8% | 100.4% |
| (114) | 96.5% | 83.4% | 112.6% | 95.7% |
| (115) | 92.1% | 82.6% | 120.2% | 97.2% |
| (116) | 98.5% | 85.5% | 123.4% | 101.6% |
| (117) | 96.9% | 84.2% | 123.0% | 98.3% |
| (118) | 93.5% | 86.2% | 117.6% | 102.3% |
| blank dyeing | 92.9% | 41.5% | 112.5% | 64.1% |
| (104)(106)(107) Example 3 Bath 4 | 92.5% | 41.7% | 118.8% | 62% |

EXAMPLE 8

10 hanks of nylon 66 staple yarn of 10 g each are dyed with the following dyes in accordance with Example 7:

treatment bath 1: no dye treatment bath 2: 0.5% of the dye of formula (100)

treatment bath 3: 0.15% or 0.5% of the dye of formula (119)

(119)

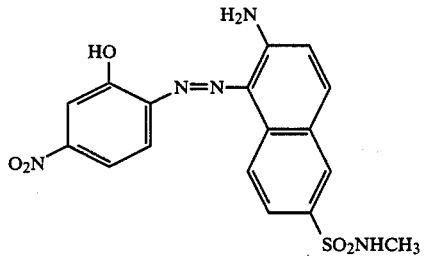

1:2 cobalt complex treatment baths 5+6: 0.5% of the dye of formula (100) in combination with 0.15% or 0.5% of the dye of formula (119)

treatment baths 7+8: 0.15% or 0.5% of the dye of formula (120)

(120)

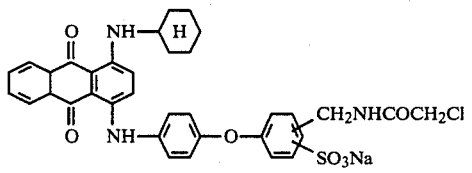

treatment baths 9+10: 0.5% of the dye of formula (100) in combination with 0.15% or 0.5% of the dye of formula (120).

The dyed yarn is wound on cardboard, exposed for 150 hours in accordance with DIN 75 202 and tested for tear strength and elongation in accordance with SNV 97 461. The results are reported in Table 7.

TABLE 7

| Treatment bath | Tear strength | Elongation |
|---|---|---|
| no treatment no exposure | 100% | 100% |
| no treatment with exposure | 6.9% | 6.3% |
| 1 | 4.5% | 5.0% |
| 2 | 49.1% | 41.9% |
| 3 | 4.3% | 6.9% |
| 4 | 9.1% | 11.5% |
| 5 | 64.9% | 57.7% |
| 6 | 70.3% | 61.6% |
| 7 | 9.3% | 9.8% |
| 8 | 14.7% | 16.6% |
| 9 | 58.6% | 54.5% |
| 10 | 66.2% | 55.1% |

EXAMPLE 9

10 hanks of nylon 66 staple yarn of 10 g each are dyed, exposed and tested as described in Examples 7 and 8. The results are reported in Table 8. The treatment baths contain the following dyes:

treatment baths 11+12: 0.1% and 0.2% of the dye of formula (115)

treatment baths 13+14: 0.1% and 0.3% of the dye of formula (121)

(121)

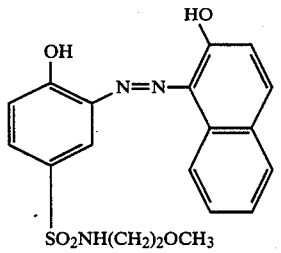

1:2 cobalt complex treatment baths 15: 0.1% of each of the dyes of formulae (115) and (121)

treatment baths 16: 0.2% of the dye of formula (115) and 0.3% of the dye of formula (121).

TABLE 8

| Treatment bath | Tear strength | *Elongation |
|---|---|---|
| 11 | 43.1% | 42.5% |
| 12 | 43.0% | 42.0% |
| 13 | 7.9% | 9.0% |
| 14 | 15.3% | 14.7% |
| 15 | 45.4% | 48.1% |

TABLE 8-continued

| Treatment bath | Tear strength | *Elongation |
|---|---|---|
| 16 | 44.7% | 41.1% |

*see TABLE 7 for values for untreated and undyed yarn

What is claimed is:

1. A process for the photochemical stabilization of synthetic polyamide fiber material, which comprises treating said fiber material with a mixture of at least one water-soluble copper complex azo or azomethine dye and at least one fiber-reactive water-soluble, non-chromophoric, organic copper complex of a bisazomethine, acylhydrazone, semicarbazone or thiosemicarbazone of an aromatic aldehyde or Ketone.

2. A process according to claim 1, which comprises the use of a water-soluble copper complex of an azo or azomethine dye of the formula

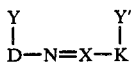

(1)

wherein D is a radical of the benzene or naphthalene series, X is a nitrogen atom or the CH group, Y is the HO—, $CH_3O$— or HOOC— group and Y' is the HO— group or an amino group, and wherein K, if X is a nitrogen atom, is the radical of a coupling component of the benzene, naphthalene or heterocyclic series or the radical of a ketomethylene compound, or, if X is the CH group, K is the radical of an o-hydroxyaldehyde.

3. A process according to claim 2, which comprises the use of a copper complex dye of the formula

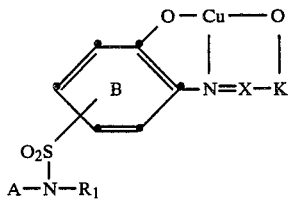

(2)

in which A is an unsubstituted or substituted carboxyphenyl or sulfophenyl radical, $R_1$ is hydrogen or $C_{1-4}$alkyl, X is a nitrogen atom or the CH group and K, if X is a nitrogen atom, is the radical of a coupling component of the benzene, naphthalene, pyrazolone, aminopyrazole, acetoacetanilide, 2,4-dioxyquinoline, pyridone or pyridine series, or, if X is the CH group, is the radical of an o-hydroxybenzaldehyde, and the ring B may be further substituted.

4. A process according to claim 1, wherein the fibre-reactive water-soluble copper complex employed is a complex of the formula

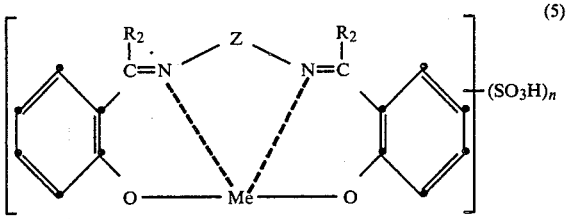

(5)

in which Me is copper, $R_2$ is hydrogen or an unsubstituted or substituted alkyl or aryl radical, Z is an unsubstituted or substituted alkylene, cycloalkylene or arylene radical and n is 1, 2 or 3.

5. A process according to claim 1, wherein the fibre-reactive, water-soluble copper complex employed is a complex of the formula

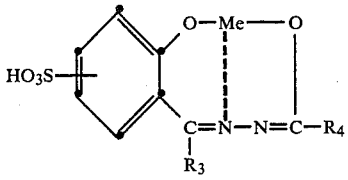

(6)

wherein Me is copper and $R_3$ and $R_4$, each independently of the other, have the same meaning as $R_2$ in claim 4.

6. A process according to claim 1, wherein the fibre-reactive water-soluble copper complex employed is a complex of the formula

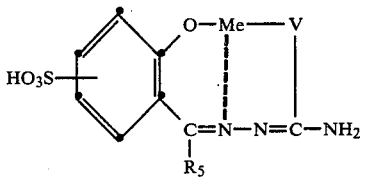

(7)

wherein Me is copper, $R_5$ is hydrogen or a substituted or unsubstituted alkyl or aryl radical and V is an oxygen or sulfur atom.

7. A process according to claim 1, which comprises the use of a mixture in which the ratio of water-soluble copper complex dye to non-chromophoric copper complex compound is 99:1 to 10:90.

8. A process according to claim 1, wherein the mixture of copper complex compounds is employed in an amount such that 2 to 1,000 μg of copper are present per g of polyamide material.

9. A process according to claim 1, wherein a mixture of copper complex compounds is used together with an acid dye.

10. A process according to claim 9, wherein a mixture of copper complex compounds is used together with an acid dye in the same dyebath.

11. A process according to claim 9, wherein the acid dye is a metal-free mono- or polyazo dye, a 1:2 chromium or 1:2 cobalt complex azo, an anthraquinone, dioxazine, phthalocyanine, nitroaryl or stilbene dye, each of which contains at least one acid group.

12. An aqueous dye liquor, which contains a mixture of at least one water-soluble copper complex azo or azomethine dye and at least one fiber-reactive, water-soluble, non-chromophoric, organic copper complex of a bisazomethine, acylhydrazone, semicarbazone or thiosemicarbazone of an aromatic aldehyde or ketone.

* * * * *